United States Patent [19]

Akiyoshi et al.

[11] Patent Number: 4,596,943

[45] Date of Patent: Jun. 24, 1986

[54] SHADOW MASK FOR A COLOR PICTURE TUBE

[75] Inventors: Eiichi Akiyoshi; Yuji Ueda, both of Hyogo, Japan

[73] Assignee: Tokyo Shibaura Denki Kabushiki Kaisha, Kawasaki, Japan

[21] Appl. No.: 575,387

[22] Filed: Jan. 30, 1984

[30] Foreign Application Priority Data

Jan. 31, 1983 [JP] Japan ..... 58-12760

[51] Int. Cl.[4] ..... H01J 29/07

[52] U.S. Cl. ..... 313/402; 445/47

[58] Field of Search ..... 313/402; 445/47

[56] References Cited

U.S. PATENT DOCUMENTS 3,905,079 9/1975 Kanai et al. ..... 445/47 X 4,160,310 7/1979 Manns ..... 445/47 X

*Primary Examiner*—Palmer C. DeMeo

*Assistant Examiner*—K. Wieder

*Attorney, Agent, or Firm*—Cushman, Darby and Cushman

[57] ABSTRACT

A shadow mask for a color picture tube, which has a plurality of regularly aligned apertures, an oxide film having good adhesion and anticorrosion characteristics which is made of a metal alloy consisting of as the major constituents, iron and nickel, wherein an iron content of at least a surface layer of a portion of the shadow mask which has the apertures is higher than that of the substrate of the metal alloy.

3 Claims, 1 Drawing Figure

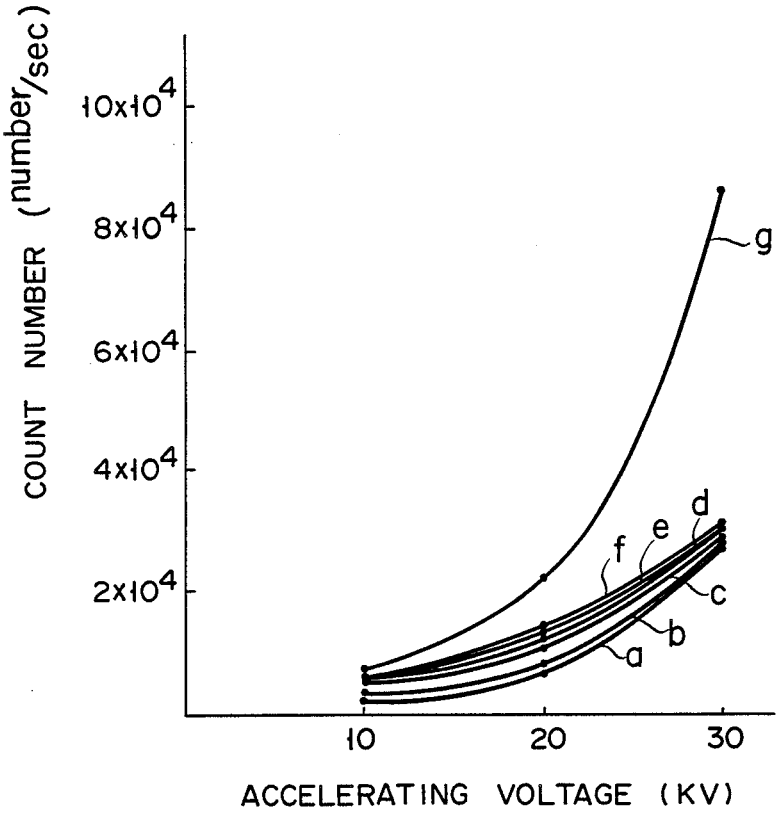
COUNT NUMBER (number/sec)
10x10^4
8x10^4
6x10^4
4x10^4
2x10^4
10
20
30
ACCELERATING VOLTAGE (KV)
a
b
c
d
e
f
g

SHADOW MASK FOR A COLOR PICTURE TUBE

BACKGROUND OF THE INVENTION

The present invention relates to a shadow mask of a color picture tube and a method of manufacturing the same.

In general, a color picture tube has an electron gun for generating three electron beams; a phosphor screen which is formed on the inner surface of a faceplate of an envelope to oppose the electron gun and which has red, blue and green emitting phosphors aligned in a predetermined sequence; and a shadow mask which opposes the phosphor screen at a predetermined distance (to be referred to as a q value hereinafter) therefrom and which has regularly formed apertures. In the color picture tube of this type, the three electron beams are converged in the vicinity of the apertures of the shadow mask and diverge in a space having the q value. The beams land on the corresponding phosphors to reproduce a color image.

This shadow mask is generally manufactured by the following process. A photosensitive layer is formed to a high-purity iron plate having a thickness of 0.1 to 0.3 mm. A mask pattern having a number of aperture images is lapped on the photosensitive layer. The photosensitive layer is exposed to the image of the mask pattern by a photo-exposure method. After development, drying and burning, the iron plate is etched, so that the iron plate has a number of apertures. The iron plate is pressed so that the portion of the iron plate which has the apertures is arcuated and that a peripheral portion thereof is formed to have a shape to be suitably mounted on a mask frame. The resultant structure is subjected to oxidation such that a dark gray or black oxide film having resistance to corrosion is formed on the surface, thereby obtaining a shadow mask. This oxide film serves: to prevent reflection of an ultraviolet ray on the shadow mask surface at the time when the phosphor screen is formed by the photo-exposure method through the shadow mask in the subsequent process; to prevent rusting before the picture tube is evacuated; to prevent the generation of secondary electrons; and to absorb the electron beam when the picture tube is operated. Oxidation methods such as steam oxidation, gas oxidation, or alkali bath oxidation can be used. The color of the oxide film is dark gray or black. In general, a blackish color is preferred.

The thickness of the oxide film preferably falls within the range between 1 $\mu$m and 3 $\mu$m, as described in Japanese Patent Disclosure No. 54-139463. When the thickness of the oxide film is less than 1 $\mu$m, rusting cannot be completely prevented. On the other hand, when the thickness is greater than 3 $\mu$m, splashing frequently occurs when the shadow mask is mounted in the color picture tube.

The material of the shadow mask generally comprises of a high-purity soft iron material. This material is selected in consideration of the supply capacity, cost, workability and strength. However, the major disadvantage of this material is its high thermal expansion coefficient of about $12\times10^{-6}$/°C. in the temperature range of 0° to 100° C. An electron beam transmittance of the conventional shadow mask is about 15% to 25%. The remaining 75% to 85% of the electron beams bombard against the shadow mask, so that its kinetic energy is converted to thermal energy. As a result, the shadow mask is often heated to a temperature of 80° C., and is subjected to a doming effect due to a high thermal expansion coefficient. Therefore, the q value locally deviates from the rated value. Such a change in the q value causes mislanding of each electron beam with respect to a corresponding phosphor, thereby degrading color purity. This tendency conspicuously occurs in a thin shadow mask having a fine aperture pitch for a high-resolution color picture tube. This problem becomes a decisive factor in the overall quality of the color picture tube.

In order to prevent the degradation of color purity, an alloy which contains as major constitutents iron and nickel and which have a thermal expansion coefficient of $5\times10^{-6}$/°C. or less (1/10 the thermal expansion coefficient of iron) in the temperature ramge of 0° to 100° C. is used as a material of the shadow mask, as described in Japanese Patent Publication No. 42-25446, Japanese Patent Disclosure No. 50-58977 and Japanese Patent Disclosure No. 50-68650. In other words, a material having a low thermal expansion coefficient is used to substantially solve the doming effect.

However, since a material containing as the major constituents iron and nickel also tends to rust like soft iron during the manufacturing process, the apertures may clog and the withstand voltage characteristics of the shadow mask may be degraded. In order to prevent this, an oxide film is formed on the surface of the shadow mask. However, it is very difficult to form a black oxide film with high heat-resistive characteristics and good adhesion on the above-mentioned alloy material. A satisfactory oxide film cannot be formed on the alloy plate surface under the normal conditions of a steam atmosphere at a temperature of 570° to 600° C., or a $CO+CO_2+O_2$ gas atmosphere at a temperature of 570° to 600° C. Even if the oxidation time is greatly prolonged (60 to 90 minutes as compared with the normal oxidation time of 5 to 10 minutes) to form an oxide film to a thickness of 1 to 3 $\mu$m, adhesion between the oxide film and the iron-nickel alloy plate is weak. The oxide film tends to peel off the plate and forms dust within the picture tube, thereby degrading the voltage withstanding characteristics.

The above problem is assumed to be caused by the following phenomenon. In general, an iron shadow mask is oxidized in a steam atmosphere or a $CO+CO_2+O_2$ gas atmosphere of 570° to 600° C. for 5 to 10 minutes to form an oxide film. The resultant oxide film is confirmed to comprise $Fe_2O_3$ and $Fe_3O_4$. The $Fe_2O_3+Fe_3O_4$ oxide film is firmly formed on the underlying iron plate and will not peel off even after the resultant structure is heated. In this manner, the oxide film can serve to prevent the shadow mask from being corroded. On the other hand, in the shadow mask having as major constituents iron and nickel, a satisfactory oxide film cannot be obtained even if the same oxidation conditions as in the case of the iron shadow mask are given. In order to obtain a sufficient thickness of the oxide film formed on the iron-nickel alloy plate, the oxidation time is increased to obtain a desired thickness. However, in this case, cracks occur in the oxide film during the subsequent heat treatment, and the oxide film peels off the iron-nickel plate. When the oxide film was analyzed in order to inquire into the causes of these phenomena, it was found that the oxide film contained nickel oxide besides $Fe_2O_3$ and $Fe_3O_4$. As a result, it is presently assumed that an oxide film having a sufficient thickness cannot be formed on the iron-nickel shadow mask since the iron concentration is low at the surface region of the plate; and that the oxide film can peel off from the plate during heat treatment since the thermal expansion coefficients of the oxide film and the plate greatly differ from each other.

SUMMARY OF THE INVENTION

The present invention has been made in consideration of the above situation, and has for its object to provide a shadow mask, wherein an oxide film is firmly formed on an iron-nickel plate to prevent the plate from being rusted.

The present inventors found that when a shadow mask is subjected to a surface treatment wherein only nickel in a surface layer of a metal alloy plate containing as major constituents iron and nickel was dissolved while the iron was protected so as to form an oxide film having a sufficient thickness on the surface of the metal alloy plate (i.e., the surface of the alloy plate is treated with a nickel stripping solution), the iron content in the surface layer is increased as compared with the initial iron content, thereby forming under normal oxidation conditions an oxide film having both good corrosion resistance and good adhesion with the underlying substrate. In this manner, since the oxide film is formed on the surface layer wherein the iron content is higher than the nickel content, the iron oxide content of the oxide film is much higher than the nickel oxide content thereof. The surface layer having a higher iron content serves as an intermediate layer between the oxide film and the underlying substrate so as to absorb thermal stress between the oxide film and the underlying substrate during the heat treatment.

According to an aspect of the present invention, there is provided a shadow mask for a color picture tube having a plurality of regularly aligned apertures and comprising a metal alloy consisting of as major constituents iron and nickel, wherein an iron content of at least a surface layer of a portion of said shadow mask which has the apertures is higher than that of the metal alloy substrate.

BRIEF DESCRIPTION OF THE DRAWING

The FIGURE is a graph showing the relationship between the accelerating voltage and the iron content of a surface layer of a shadow mask in accordance with an EPMA analysis.

DETAILED DESCRIPTION OF THE PREFERRED EMBODIMENT

The effect of the present invention will be described in detail by way of examples.

EXAMPLE 1

Apertures were formed in a predetermined pattern by photoetching on a metal alloy plate which had a thickness of 0.1 mm and which contained as major constituents 36% nickel and iron. The resultant structure was vacuum-annealed at a temperature of 1,100° C.; wrinkles formed during annealing were removed by a leveler. Afterwards, the resultant structure was subjected to a chemical treatment.

A chemical treatment solution was ENSTRIP S (trade name for stripping agent for a nickel film plated on an iron plate; available from Japan Metal Finishing Company).

Six samples were treated with the stripping solution containing 60 g/l of ENSTRIP S and 100 g/l of NaCN for different treatment times. Iron contents of the treated samples were measured as counts of an electron probe X-ray microanalyzer (EPMA) per second, respectively. Results are shown in FIG. 1. According to this graph, when the treatment time is increased, the count within the low accelerating voltage region is increased, thereby indicating that the iron content in the surface layer is increased.

Curves (a) to (g) correspond to treatment times shown in Table 1, respectively.

The resultant flat mask was pressed such that a portion having the apertures was curved and a peripheral portion was shaped as a skirt portion which could be suitably mounted on a mask frame.

The masks were degreased by Tricrene and were placed in a $Co+CO_2+O_2$ gas atmosphere at a temperature of 570° to 600° C. to form oxide films thereon, respectively.

The adhesion and anticorrosive characteristics of the oxide films of the shadow masks are shown in Table 1.

TABLE 1

| | | Measurements of Properties of Oxide Film | | | | |
|---|---|---|---|---|---|---|
| | | Item | | | | |
| | | | | Corrosion resistance (rate of corrosion occurred in corrosion test) No. of testing days | | |
| Chemical treatment time | | Thickness of oxide film (μm) | Adhesion of oxide film | After 1 day (%) | After 2 days (%) | After 3 days (%) |
| a | No treatment | 0.5 or less | — | 6 | 20 | 43 |
| b | 30 seconds | 0.5 | Δ | 3 | 8 | 15 |
| c | 1 minute | 1.5 | o | 0 | 2 | 7 |
| d | 3 minutes | 2.5 | o | 0 | 3 | 9 |
| e | 5 minutes | 4.0 | Δ | 0 | 4 | 8 |
| f | 10 minutes | 7.0 | x | 10 | 28 | 53 |
| g | Control: pure iron mask | 2.0 | o | 2 | 3 | 17 |

Film thickness: Film section was polished and subjected to measurement with a optical microscope.
Film adhesion: After heating the shadow mask at 450° C. × 60 min in an electric furnace, the shadow mask was bent at 90° at a radius of curvature R of 1 mm. A cellophane tape piece was adhered to the oxide film and was peeled to examine the peeling degree of the oxide film. Marks o, Δ and x in the table indicate various degrees of peeling; o, no peeling; Δ, slight peeling; and x, peeling to an unsatisfactory degree.
Corrosion resistance: After leaving the shadow mask in an atomosphere at a temperature of 35° C. and a relative humidity of 90 to 95%, the rate of corrosion which occurred was observed (forcive testing).

It is found that the shadow masks treated with the chemical treatment solution described above at a temperature of 80° C. for 1 to 3 minutes have the same adhesion, (heat-resistive properties) and anti-corrosion characteristics as, or greater adhesion and anti-corrosion characteristics than, those of the conventional pure-iron shadow mask.

The shadow masks as shown by samples (c) and (d) in Table 1 were assembled into color picture tubes, respectively. These shadow masks were subjected to general annealing, thereby preparing the finished color picture tubes which were then operated. The degradation of color purity due to thermal expansion of the shadow masks was negligible. The apertures would not clog, thereby providing a good withstand voltage chartacteristics. In this manner, even if the iron content of the surface layer was increased by the chemical treatment, the change in thermal expansion coefficient of the material was found to be negligible.

Furthermore, when the picture tubes were disassembled to check the surface states of the oxide films of the shadow masks, substantially no dust and cracks of the oxide films were observed.

EXAMPLE 2

The chemical treatment was performed after the shadow mask was pressed and degreased by Tricrene. Thereafter, the oxidation treatment was performed. The remaining procedures were the same as those of Example 1. As a result, the shadow mask had the same effect as in Example 1.

EXAMPLE 3

The chemical treatment was performed after photoetching. Subsequently, vacuum annealing was performed. The subsequent processes were leveler-press shaping and the oxidation treatment. Any other process and the treatment conditions were the same as those of Example 1. In Example 3, nickel was slightly diffused in the surface layer since chemical treatment was followed by the vacuum annealing, so that the iron content was slightly decreased. However, the shadow mask of Example 3 was practically satisfactory.

In the above examples, the alloy material contains 36% nickel. However, a material containing 42% nickel, 50% nickel, or super Invar containing 32% Ni and 5% Co can be used.

As is apparent from the above examples, the shadow mask for the color picture tube which has an oxide film having good adhesion and anticorrosion characteristics can be obtained. The resulting shadow mask is free from peeling, dust formation, cracks and rusting.

What is claimed is:

1. A shadow mask for a color picture tube having a plurality of regularly aligned apertures, comprising:

a metal alloy plate including iron and nickel as its major constituents, the iron content of a surface layer of at least a portion of said shadow mask being higher than the iron content of a substrate of the metal alloy plate; and an oxide film formed on the metal alloy plate, the iron content of a surface layer allowing improved bonding between the metal alloy plate and the oxide film.

2. A shadow mask as in claim 1 wherein an iron content of said oxide film formed on said metal alloy plate layer is higher than that of a substrate of said metal alloy plate.

3. A shadow mask as in claim 2 wherein said portion of said shadow mask with the higher iron content is a portion whereat said apertures are formed.

* * * * *